United States Patent [19]

Moraw

[11] 4,135,807

[45] Jan. 23, 1979

[54] APPARATUS FOR THE REPEATED RECORDING OF DEFORMATION IMAGES ON A RECORDING MATERIAL

[75] Inventor: Roland Moraw, Naurod, Fed. Rep. of Germany

[73] Assignee: Hoechst Aktiengesellschaft, Frankfurt am Main, Fed. Rep. of Germany

[21] Appl. No.: 666,980

[22] Filed: Mar. 15, 1976

[30] Foreign Application Priority Data

Mar. 17, 1975 [DE] Fed. Rep. of Germany ..... 2511633

[51] Int. Cl.$^2$ ..... G03G 16/00

[52] U.S. Cl. ..... 355/9; 346/151

[58] Field of Search ..... 355/9, 3 R; 346/151; 340/173 TP; 96/1.1; 358/129; 250/326; 365/126

[56] References Cited

U.S. PATENT DOCUMENTS

| | | | |
|---|---|---|---|
| 3,245,053 | 4/1966 | Brown et al. | 340/173 TP |
| 3,672,883 | 6/1972 | Ciccarelli et al. | 355/9 X |
| 3,698,893 | 10/1972 | Heurtley | 355/9 |
| 3,795,514 | 3/1974 | Jvirblis et al. | 340/173 TP |
| 3,836,362 | 9/1974 | Goffe | 96/1.1 |
| 3,874,789 | 4/1975 | Weber | 250/326 X |
| 4,034,381 | 7/1977 | Moraw et al. | 346/151 |

*Primary Examiner*—A. D. Pellinen

*Attorney, Agent, or Firm*—Bacon & Thomas

[57] ABSTRACT

A method and apparatus for repeated recording and quenching or erasing of deformation images on a recording material composed of a photoconductive thermoplastic recording layer arranged on a dielectric support layer wherein the development and quenching is effected by thermal heat supplied to a conductive layer on a film rostrum above which the recording material, which carries a charge image, is transported. Before and during the thermal quenching by a movable corona device, electrostatic charges are applied to the recording layer. The charges have a polarity opposite to that of the charge image on the recording layer. This charge image is produced by the application of an electrostatic charge and the exposure of the charged surface of the recording layer to an image pattern. The high voltage of the corona device is reversible when the corona device is switched from forward to backward movement.

2 Claims, 3 Drawing Figures

APPARATUS FOR THE REPEATED RECORDING OF DEFORMATION IMAGES ON A RECORDING MATERIAL

BACKGROUND OF THE INVENTION

1. Field of the Invention

The present invention relates to a method of repeated recording and quenching or erasing of deformation images on a surface of a recording material, which recording material is composed of a photoconductive, thermoplastic recording layer supported by an electrically non-conductive support layer and to an apparatus for carrying out the foregoing method.

2. Description of the Prior Art

Photothermoplastic recording materials having a photoconductive and thermoplastic recording layer as well as the various steps for the recording by electrostatic charging, informationwise exposure and thermal development to form a relief image are known, for example, from German Pat. No. 1,537,134. In general photothermoplastic recording materials consist of a support having a transparent and conductive layer, to which small quantities of a photoconductive layer are applied that consist of poly-N-vinyl carbazole and additives such as 2,4,7-trinitro fluorenone. A thermoplastic layer is applied thereon that consists, for example, of Staybelite-Ester 10®, a hydrogenated colophony ester manufactured by Hercules. The coating technique and the sensitometric properties of such layers have been described in detail by, among others, Credelle et al., RCA Review, 33 (1972), pages 217 ff. The deformation images on such layers can after the recording be quenched by re-heating them until the relief image is smoothed, and the layer can then be imaged again. The relief images or deformation images are preferably holograms, which are recorded with the aid of laser beams.

Photothermoplastic layers containing poly-N-vinyl carbazole are also used in an embodiment in which the recording layer is applied directly to a flexible support layer, which may consist of polyester, for example, without a conductive intermediate layer (German Offenlegungsschrift No. 2,262,917). This recording material is of great interest in practice, because it works without the transparent and conductive layer, the application of which is technologically complicated. The recording and quenching or erasing of deformation images can be carried out in a manner similar to that including a recording material having a conductive intermediate layer. However, in the case of repeated recordings after previous quenching the image intensity becomes worse with each recording cycle, so that after less than 10 cycles it is impossible to make a recording and obtain a satisfactory image quality.

Compensating chargings. i.e. changing the charging polarity during a series of recordings, of photothermoplastic layers having pyrene resins as a photoconductor are known from German Offenlegungsschrift No. 2,233,878. Up to now this technique has not had any success with layers containing poly-N-vinyl carbazole. Such thermoplastic recording layers containing poly-N-vinyl carbazole were provided with a positive charge for the recording. In the case of a negative charge their light sensitivity was not sufficient for practical use.

SUMMARY OF THE INVENTION

Accordingly, it is the object of the present invention to improve the method described above in such a manner that a repeated recording and quenching of deformation images on one recording material becomes possible, the recording material consisting of a recording layer and a support layer which are connected to each other without an electrically conductive intermediate layer, excluding a deterioration of the image quality even after numerous recording cycles, and an apparatus for carrying out this method.

Briefly, the method of repeated recording and quenching or erasing according to the invention comprises the following steps:

(a) applying an electrostatic charge with a predetermined polarity to the photoconductive, thermoplastic recording layer;

(b) exposing the electrostatically charged surface to an image pattern to produce a charge image;

(c) developing said charge image by supplying thermal heat to the photoconductive thermoplastic recording layer;

(d) quenching or erasing the charge image developed by step (c) by feeding thermal heat and applying electrostatic charges, before or during the quenching, or erasing to said photoconductive thermoplastic recording layer, the electrostatic charges having a polarity opposite to that of the charge image and (e) repeating at least once the steps (a) to (d).

The quantity of the charge applied before or during the thermal quenching is determined in such a manner that the quantity of the charge previously applied and having an opposite polarity is just compensated. This is necessary, since it turned out that an additional negative charge on its own does not render possible a cyclic recording, if the charge is not applied at the right moment and in the required height.

The cyclic recording on photothermoplastic layers is achieved with convincing and surprising success each time elestostatic charges having a negative polarity are applied to the recording layer before or during the thermal quenching.

It is preferred to apply an a.c. voltage to the recording layer as a compensation for the quantity of charge applied previously to the recording layer.

The recording layer preferably contains poly-N-vinyl carbazole and 2,4,7-trinitro fluorenone, the quantity of 2,4,7-trinitro fluorenone ranging from one fifth to one twentieth of the weight of the recording layer and is arranged on a flexible and dielectric film as an electrically non-conductive support layer.

An apparatus for the repeated recording and quenching of deformation images on a surface of a recording material, the material being composed of a photoconductive, thermoplastic recording layer supported on an electrically nonconductive support layer, comprises a corona device for applying an electrostatic charge with a predetermined polarity to the photoconductive, thermoplastic recording layer, camera means for the exposure of the electrostatically charged surface to an image pattern to produce a charge image, a unit for the control and voltage supply to the apparatus, a film rostrum that has an electrically conductive layer and is heatable from the unit, via the conductive layer, the recording material being guided to develop or to quench the charge image by supplying thermal heat to the photoconductive, thermoplastic recording layer by the heated conductive layer of the film rostrum, said corona device being movable forward and backward over the charge image on the recording layer to apply electrostatic charges, before or during the quenching, to the recording layer, these charges having a polarity opposite to that of the charge image, the polarity of a high voltage supply to the corona device being reversed when the corona device is switched from forward to backward movement.

The corona device is preferably connected to a high voltage supply via a high voltage changeover switch in between, which in turn is connected to a relay circuit that may be actuated via a second switch for interrupting the voltage supply of a first motor that drives the corona device, for switching off the high voltage supply and for reversing the high voltage changeover switch.

In a preferred embodiment the second and the first switch are arranged at the turning point of the path of movement of the corona device and at the beginning of this path of movement, respectively, both switches being actuatable via a cam arranged at the corona device.

Furthermore, a return switch is provided for starting the quench cycle manually. By actuating this switch the second switch is bridged via the relay circuit, a reversed voltage, which effects the return movement of the corona device, is applied to the first motor and the high voltage supply is started which applies, via the reversed high voltage changeover switch, a polarity to the corona device that is opposite to the polarity of the high voltage during the forward movement.

In a slightly modified embodiment of the invention the corona device consists of two separate coronas, each of which has its own high voltage supply and which supply high voltages of opposite polarities and can be switched on and off successively.

DETAILED DESCRIPTION OF THE PREFERRED EMBODIMENTS

Figure 1:
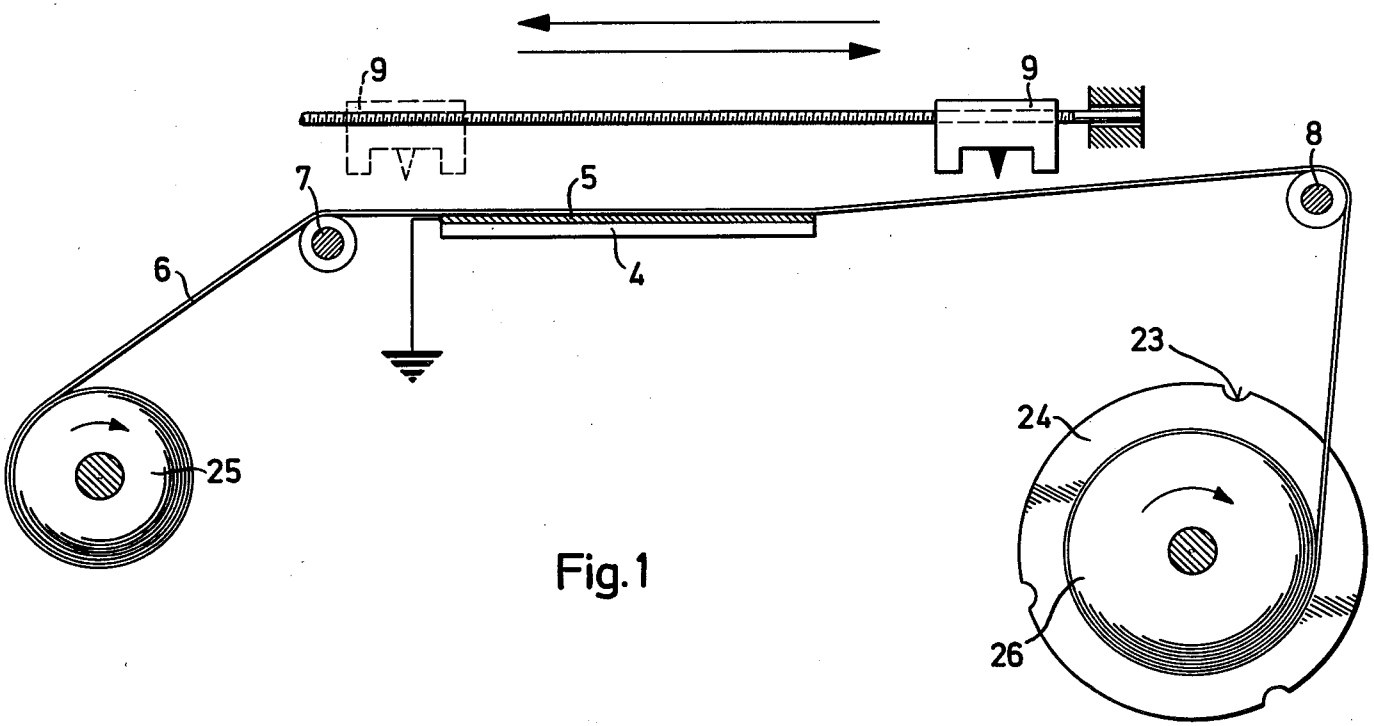
FIG. 1 is a detailed schematic view of a recording rostrum having a movable corona device a supply spool and a winding spool for the recording material.
Figure 2:
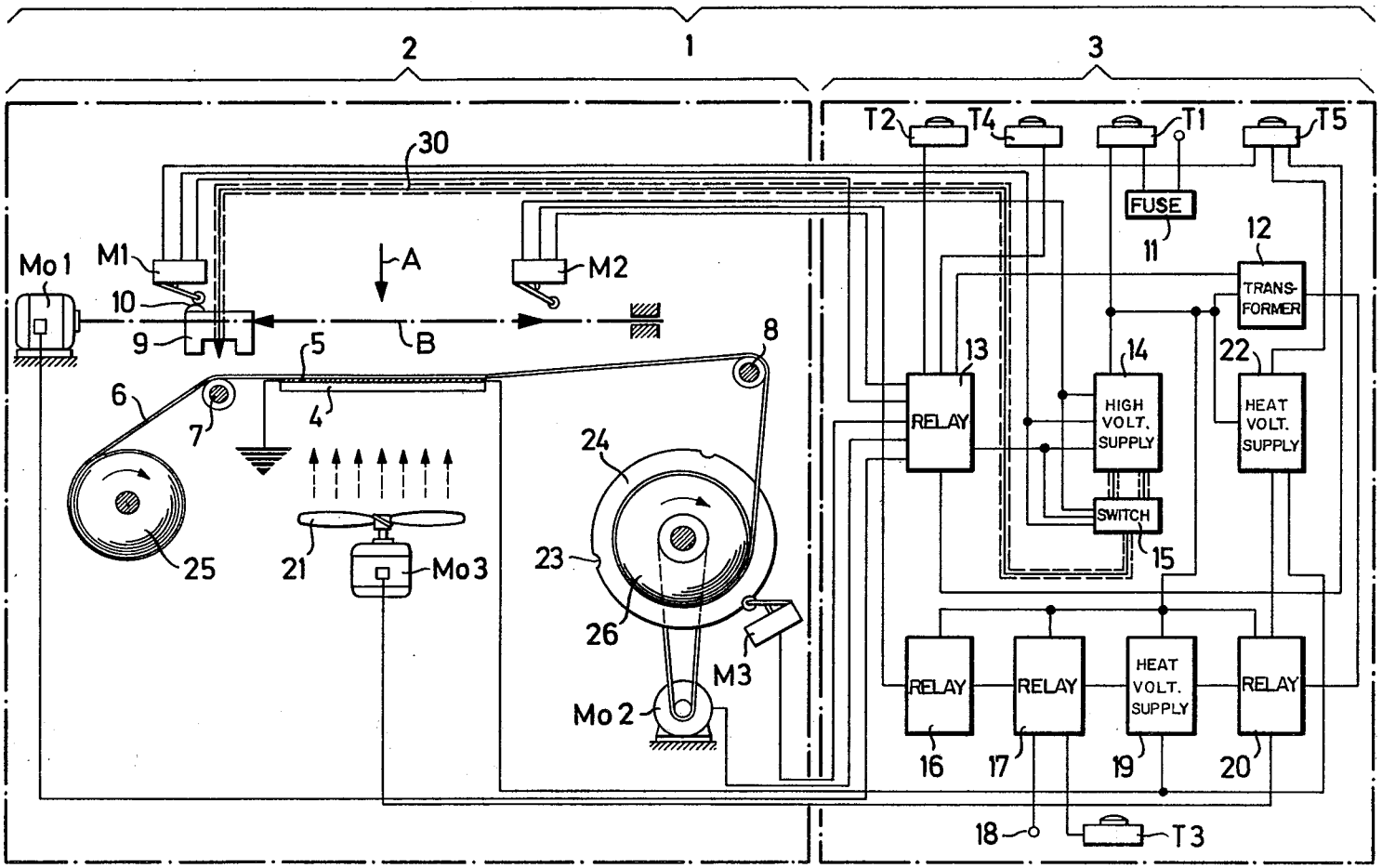
FIG. 2 is a schematic view of an embodiment of the apparatus, consisting of a camera control and voltage supply unit

As shown in FIG. 2, a recording apparatus 1 consists of a camera 2, through which the recording material 6 passes, and of a control and supply unit 3. The camera 2 contains a film rostrum 4 having a conductive layer 5 over which the recording material 6 is guided with the recording layer facing upward, as shown in FIG. 1. The recording material 6 passes from a supply spool 25 via a first deviating roller 7, a film rostrum 4 and a second deviating roller 8 onto a winding spool 26 driven by a second motor $M_{02}$. A corona device 9 can be moved in the directions indicated by the double arrow B in the area of the film rostrum 4 above the recording material 6. The corona device 9 carries a cam 10 that actuates a first switch $M_1$ and a second switch $M_2$. The switches $M_1$ and $M_2$ are arranged at the beginning and at the end of the path of movement of the corona device 9. In FIG. 1 the corona device 9 at the beginning of the path of movement, which is also the first of the turning points of the corona movement, is shown in broken lines, whereas the corona device 9 at the second turning point at the end of the path of the corona is shown in uninterrupted lines.

The radiation acts upon the film rostrum 4 in the direction indicated by the arrow A. The apparatus 1 is switched on by a mains switch $T_1$ via a fuse 11. The mains switch $T_1$ is connected to a mains transformer 12 that feeds the drive voltage, for example a d.c. voltage of 6 volts, for the first motor $M_{01}$, the second motor $M_{02}$ and a third motor $M_{03}$, into a relay circuit 13 that is connected to these motors. The third motor $M_{03}$ drives a ventilator 21, which is arranged below the film rostrum 4 for cooling purposes.

By actuating a starting switch $T_2$, which is connected to the relay circuit 13, the recording cycle is started, the first motor $M_{01}$ that moves the corona device 9 in FIG. 2 from left to right is provided with a voltage by the relay circuit 13. At the same time the first switch $M_1$ is bridged in the relay circuit 13, to which it is also connected. The relay circuit 13 is also connceted to a controllable high voltage supply 14 for the corona device 9. A screened conduit 30 leads from this high voltage supply 14, via a high voltage changeover switch 15, to the corona device 9, which is for example supplied with a high voltage having a positive polarity. At the end of the path of movement of the corona device 9 the second switch $M_2$, usually a micro switch, is actuated by the corona device 9 via the cam 10. The second switch $M_2$ interrupts the voltage supply of the first motor $M_{01}$ via the relay circuit 13, whereby the movement of the corona device 9 is stopped. Furthermore, it switches off the high voltage supply 14 and reverses the high voltage changeover switch 15. Moreover, the second switch $M_2$ is connected to a time lag relay 16 the delay time of which can be controlled and by the time constant of which a delay of the start of the exposure for the recording material 6 may be adjusted, in order to wait for possible mechanical vibrations of the movable corona device 9 to subside. The time lag relay 16 is connected in series to a time delay relay 17, a controllable heating voltage supply 19 for the conductive layer 5 of the film rostrum 4 and to another time delay relay 20. For the exposure of the recording material a voltage signal is fed from the time delay relay 17 via a contact 18 into an electronic diaphragm shutter. After the exposure the heating voltage supply 19 is actuated, the voltage of which can be controlled with regard to their duration and height, in order to heat the conductive layer 5 for the thermal development of the recording material 6 that lies on the film rostrum 4. If instead of an electronic diaphragm shutter an exposure control is provided that cannot be operated automatically, the continuation of the program must be actuated via a program switch $T_3$, which is connected to the time delay relay 17. Subsequently the third motor $M_{03}$ that operates the ventilator 21 is actuated via the time delay relay 20, which has a controllable time constant.

Since the length of time for evaluation observation or utilization of the information recorded differs from recording to recording, a manual start of the quench cycle is preferred to an automatic continuation after termination of the recording cycle. For this purpose a return switch $T_4$ is provided which is connected to the relay circuit 13. By actuating the return switch $T_4$ the second switch $M_2$ is bridged in the relay circuit 13 and a reversed voltage for the backward movement of the corona device 9, which moves from right to left in FIG.

2, is applied to the first motor $M_{01}$. At the same time the high voltage supply 14 is started via the relay circuit 13 so that the corona device 9 is supplied, via the reversed high voltage changeover switch 15, with a high voltage having a negative or alternating polarity. As soon as the cam 10 on the corona device 9 actuates the first switch $M_1$ the backward movement of the corona device 9 is interrupted, the high voltage supply 14 is switched off and the high voltage changeover switch 15 is reversed. The high voltage supply 14 and the high voltage changeover switch 15 are connected to the first switch $M_1$, which in turn is connected to a changeover switch $T_5$. This changeover switch $T_5$ is connected with a relay circuit 13 and with another heating voltage supply 22, which is connected to the conductive layer 5 of the film rostrum 4. By actuating the changeover switch $T_5$ via the first switch $M_1$ thermal energy for the quenching of the deformation images on the recording material 6 reaches the conductive layer 5 of the recording material 6. The second heating voltage supply 22 is controllable as regards the duration of heating and the height or magnitude of the heating voltage.

Since the switch $T_5$ is a manually operated switch, it may be closed at the operator's option instead of by the switch $M_1$. Accordingly, it may be closed so that heating of the recording material 6 by the film rostrum 4 occurs during, or simultaneously with, applying the opposite polarity charge in order to effect erasure of the image. For example, the switch $T_5$ could be closed prior to or at the same time switch $T_4$ is closed.

After termination of the quenching process the third motor $M_{03}$ that operates the ventilator 21 is started via the time delay relay 20.

For the transport of the recording material 6 the return switch $T_4$ and the changeover switch $T_5$ are actuated. The corona device 9 moves, while applying a compensating charge to the recording material 6, back to its starting position, which is shown in broken lines in FIG. 1. The cam 10 at the corona device 9 actuates the first switch $M_1$, which switches off the high voltage supply 14, reverses the high voltage changeover switch 15 and switches off the first motor $M_{01}$, which drives the corona device 9, via the relay circuit 13. A third switch $M_3$, for example a micro switch that is arranged near the surface of the winding spool 26, is bridged for a short time via the changeover switch $T_5$ and the relay circuit 13, and the second motor $M_{02}$, which drives the winding spool 26, is actuated until the third switch $M_3$ switches it off by engaging in a groove 23 of a cam disk 24. The cam disk 24 connected to the winding spool 26 is provided with grooves 23, which are arranged at the same distance from each other. The third switch $M_3$ is connected to the relay circuit 13, which in turn is connected to the second motor $M_{02}$. By the third switch $M_3$ engaging in one of the grooves 23 the bridging of the third switch $M_3$ by means of the relay circuit 13 is stopped and the relay circuit 13 switches off the second motor $M_{02}$. The number of grooves 23 on the cam disk 24 is such that in each case a portion of the recording material 6 having a length corresponding to the length of the film rostrum 4 is unwound from the supply spool 25 and wound onto the winding spool 26, when the winding spool 26 has turned so far that its turning movement corresponds to the distance between two neighbouring grooves.

Figure 3:
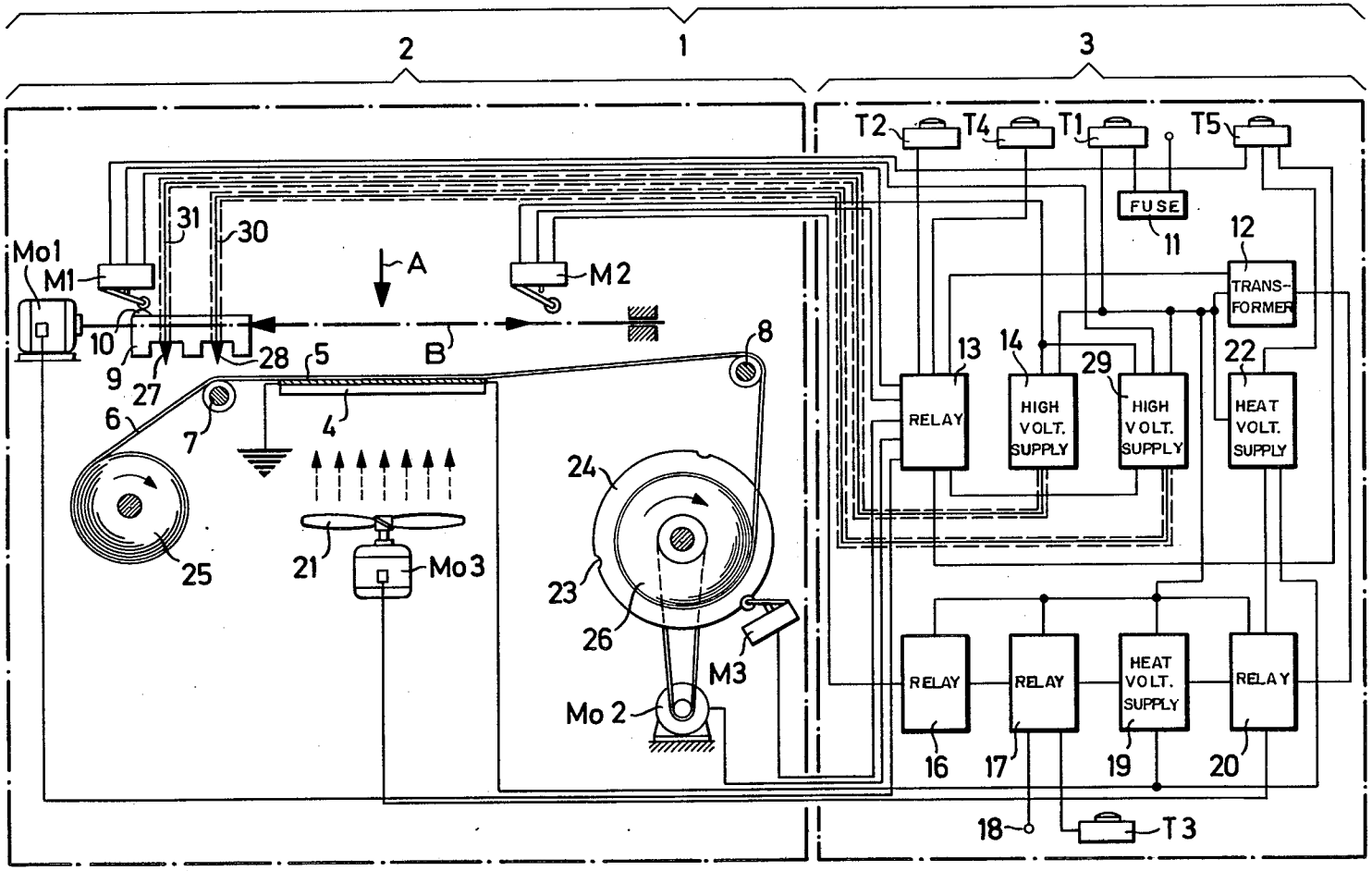
FIG. 3 is a slightly modified embodiment of the apparatus according to FIG. 2.

In the embodiment shown in FIG. 3 a corona device 9 is provided that has two coronas 27, 28, which are connected to the high voltage supplies 14, 29. At the beginning of the recording cycle, for example, only the first corona 27 is fed with a positive high voltage, whereas the second corona 28 is switched off. By actuating the starting switch $T_2$ the recording cycle is started, the first motor $M_{01}$ being provided with a voltage via the relay circuit 13 and moving the corona device 9 in FIG. 3 from left to right. The switch $M_1$ is thus bridged in the relay circuit 13. At the same time, i.e. at the beginning of the recording cycle, only the first high voltage supply 14 is switched on and fed, for example, with a positive high voltage via the screened high voltage conduit 31, whereas the second corona 28 is switched off. As soon as the corona device 9 has reached the right turning point at the end of its path of movement the first high voltage supply 14 is switched off via the second switch $M_2$, the second high voltage supply 29 is switched on and applies to the corona 28 connected with it, via a second screened high voltage conduit 30, a negative voltage having the same height or magnitude as the high voltage of the first corona 27 or an a.c. voltage, so that during the backward movement of the corona device 9 the quantity of the charge applied to the recording material 6 is compensated. At the same time the second switch $M_2$ interrupts the voltage supply for the first motor $M_{01}$ and thus stops the movement of the corona device 9.

The quenching cycle is started either automatically after the termination of the recording cycle by the backward movement of the corona device 9 or manually by actuating the return switch $T_4$. Thus the second switch $M_2$ is bridged in the relay circuit 13 and a reversed voltage for the backward movement of the corona device 9 is applied to the first motor $M_{01}$. At the same time the first high voltage supply 14 is switched off via the relay circuit 13 and the second high voltage supply 29 is energized. Thus the second corona 28 is supplied with a high voltage having a negative or alternating polarity, as mentioned above.

In this embodiment the high voltage changeover switch 15 according to FIG. 2 becomes redundant and is no longer necessary since it is replaced by the second high voltage supply 29. Compared to the embodiment according to FIG. 2 the other elements and switching units remain unchanged with regard to their form and action.

The apparatus works in the following manner:

During the charging the recording material 6 is on the film rostrum 4, which is also an earthed or grounded counter electrode to the corona device 9. If the charging is carried out with a direct current corona having a positive polarity, a direct current corona having a negative polarity is used for charging before the quenching. The charging carried out as a pre-treatment may also be effected with an alternating current corona. For the following thermal quenching, three times the thermal energy used for the thermal development is produced by heating the counter-electrode that serves as a heating plate. The recording layer is arranged direct on a polyester film having a thickness of, for example, 50μ. The light sensitivity of the photoconductor layer composed of poly-N-vinyl carbazole may, as is known, be increased by adding dyes such as brilliant green or in particular by adding electron acceptors such as 2,4,7-trinitro fluorenone. For the sake of a better transparency due to fewer complexes in the layer and for reasons of a reduced dark conductivity only about one tenth of the weight of the recording layer of 2,4,7-trinitro fluorenone is added to the photoconductor layer composed of poly-N-vinyl carbazole. The cyclic recording process according to the invention can also be carried out without difficulty with one fifth or one twentieth of the weight of the recording layer of 2,4,7-trinitro fluorenone. For the cover layer of the recording layer thermoplasts such as colophony ester, polystyrenes or copolymers of styrenes and acrylates may be used without causing significant differences in the quenchability of the deformation images.

The photothermoplastic recording material 6, which is arranged on a flexible film support, passes from a supply spool 25 over the film rostrum 4 to the winding spool 26. The recording material 6 is guided over the earthed or grounded and transparent film rostrum 4 with its recording layer facing upward. The rostrum 4 consists of a glass plate having a conductive, transparent layer 5, which is earthed or grounded. By charging the recording material 6 electrostatically with a positive polarity during the forward movement of the corona device 9, in FIGS. 1 to 3 from left to right, the recording material 6 is rendered light-sensitive and simultaneously adheres to the film rostrum 4 because of electrostatic adhesion. After the charging thermal development is carried out, for which purpose the conductive layer 5 of the film rostrum 4 is thermally heated by joule heat from the first heating voltage supply 19 or is cooled by the ventilator 21 and after the recording, the backward movement, of the corona device 9 is started by a switching signal, which is preferably triggered manually by the return switch $T_4$ and the changeover switch $T_5$. During its backward movement the corona device 9 is operated with a high voltge having a negative or alternating polarity. Thus, the positive residual charges on the recording material 6 in the area of the film rostrum 4 are compensated for. When the corona device 9 reaches its left turning point, a new portion of the recording material 6 may be passed above the film rostrum 4 by transporting the recording material 6 farther to the right. The transport is carried out without difficulty by unwinding the recording material 6, since the electrostatic adhesion of the recording material to the film rostrum 4 is eliminated by the charge compensation during the backward movement of the corona device 9. In order to facilitate the unwinding of the recording material 6 it is unwound at a small angle of about 5° to the level of the film rostrum 4. The recording material 6, which still adheres slightly to the film rostrum 4, may be heated from the layer 5 of the film rostrum 4 until the deformation image is smoothed. The heating of the recording material 6 by joule heat from the film rostrum 4 is a well reproducible or convenient technique, but other heating techniques such as infrared radiation or hot air may be applied, too. The new section of the recording material 6 that is in front of the film rostrum 4 or the portion of the recording material 6 carrying the quenched deformation image is again provided with a positive charge during the forward movement of the corona device 9 into the position on the right hand side and is thus sensitized for a new recording cycle.

If a corona device 9 having a single corona is used (as is shown in FIG. 2), it must be connected, during its forward and backward movements, to the reversed high voltage source, via the high voltage changeover switch 15. Without the high voltage changeover switch 15 the two coronas 27, 28 (of FIG. 3) may be provided in the corona device 9, which have to be supplied separately with a high voltage and can be switched on and off. In the case of a positive high voltage of the first corona 27 a negative or alternating high voltage is applied to the second corona 28.

After recording of the relief image, which is carried out with a positive charge, a negative charge is applied and only then is the relief image thermally quenched until the surface is smooth. Quenching without sensitization for the following recording is achieved to the same extent if the negative charge is applied during the thermal quenching. The lightest images in a series are obtained, even in the case of a greater number of recording cycles, if the quantity of the negative charge applied corresponds fairly exactly to the quantity of the positive charge applied before.

One hundred cycles were carried out as a test according to the method described above and relief grids were produced by two-beam interferences of a He-Ne laser. During the first five cycles the efficiency of diffraction, i.e. the intensity ratio between the light diffracted in first order and the irradiated light, decreases by approximately one third. At the beginning unknown formation processes probably take place in the recording layer that cause the decrease in intensity of diffraction at the beginning of the recording. Such a strong initial decrease also occurs at otherwise equal layers on supports having a conductive intermediate layer. During the further recording cycles up to the one hundredth cycle the efficiency of diffraction decreases relatively slowly by another third.

What is claimed is:

1. An apparatus for the repeated recording and erasing of deformation images on a surface of a strip of recording material, wherein said material is composed of a photoconductive, thermoplastic recording layer supported by an electrically non-conductive support layer, said apparatus comprising:

a corona device for applying an electrostatic charge with a predetermined selected polarity to the photoconductive thermoplastic recording layer;

high voltage power supply means for charging the corona, the high voltage supply having outputs of opposite polarity;

camera means for exposing the electrostatically charged surface to an image pattern to produce a charge image;

a film rostrum having a thermally conductive layer wherein the conductive layer is heatable by electric power supplied from said power supply means;

first motor means for advancing the strip of recording material over the film rostrum to both develop and erase the charge image, whereby development and erasure is accomplished by supplying heat energy to the photoconductive, thermoplastic recording layer via the heated conductive layer of the film rostrum;

second motor means for moving said corona device forward and backward along a path over the recording layer to apply electrostatic charges thereto to charge the layer prior to creating the charge image and to assist in erasing the charge image therefrom;

switch means for controlling the operation of said apparatus, the switch means comprising:

first switch means positioned at the beginning of the path over which the corona device moves for operation by the corona device when the corona device is returned to the beginning of the path by the second motor means;

second switch means positioned at the end of the path over which the corona device moves for operation by the corona device when the corona device is advanced to the end of the path by the second motor means;

a high voltage change-over switch for switching the polarity of voltage supplied to the corona charging device by the high voltage power supply means;

a motor power switch connecting said second motor to the power supply;

a relay circuit operating the high voltage change-over switch and motor power switch;

means connecting the relay circuit to the first and second switch means, whereby, when the corona device arrives at either the beginning of the path or the end of the path, the high voltage change-over switch reverses polarity of the voltage supplied to the corona device, and wherein, when the corona device arrives at the end of the path and operates the second switch, the motor power switch interrupts power to the motor; and manual switch means for bridging the motor power switch and reversing the polarity of the second motor when the second switch is operated by the corona charge device and also when the corona charge device returns to the beginning of the path while applying a charge to the recording material opposite that on the recording material, to thereby assist in erasing the charge image.

2. The apparatus of claim 1 wherein the corona device includes two coronas, one of which is connected to an output of one polarity and the other of which is connected to an output of the other polarity.

* * * * *

UNITED STATES PATENT AND TRADEMARK OFFICE

CERTIFICATE OF CORRECTION

PATENT NO. : 4,135,807

DATED : January 23, 1979

INVENTOR(S) : Roland Moraw

It is certified that error appears in the above-identified patent and that said Letters Patent are hereby corrected as shown below:

Column 2, line 42, delete "elestostatic" and insert therefor --electrostatic--.

Column 3, line 41, after "device" insert a comma (--,--); and line 44, after "camera" insert --, a--.

Column 4, line 21, delete "connceted" and insert therefor --connected".

Column 7, line 32, delete "voltge" and insert therefor --voltage--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*